US008610357B2

(12) United States Patent
Stoll et al.

(10) Patent No.: US 8,610,357 B2
(45) Date of Patent: Dec. 17, 2013

(54) LED ASSEMBLY FOR A SIGNAGE ILLUMINATION

(75) Inventors: Arnold Stoll, Romeo, MI (US); Paul Von Zittwitz, Macomb, MI (US)

(73) Assignee: ZON LED, LLC, Romeo, MI (US)

( * ) Notice: Subject to any disclaimer, the term of this patent is extended or adjusted under 35 U.S.C. 154(b) by 0 days.

(21) Appl. No.: 13/620,710

(22) Filed: Sep. 15, 2012

(65) Prior Publication Data

US 2013/0010468 A1 Jan. 10, 2013

Related U.S. Application Data

(63) Continuation-in-part of application No. 12/790,745, filed on May 28, 2010, now abandoned.

(60) Provisional application No. 61/181,698, filed on May 28, 2009, provisional application No. 61/307,837, filed on Feb. 24, 2010.

(51) Int. Cl.

| | |
|---|---|
| ***H01J 7/24*** | (2006.01) |
| ***H01J 13/32*** | (2006.01) |
| ***H01J 17/28*** | (2006.01) |
| ***H01J 19/74*** | (2006.01) |
| ***H01J 61/52*** | (2006.01) |

(52) U.S. Cl.

USPC ..... 315/112; 315/161; 315/312

(58) Field of Classification Search

None

See application file for complete search history.

(56) References Cited

U.S. PATENT DOCUMENTS

| | | | | |
|---|---|---|---|---|
| 5,365,411 | A | 11/1994 | Rycroft et al. | |
| 6,028,694 | A | 2/2000 | Schmidt | |
| 6,918,684 | B2 | 7/2005 | Harvey | |
| 7,182,480 | B2 | 2/2007 | Kan | |
| 7,208,881 | B2 | 4/2007 | Young | |
| 7,455,431 | B2 | 11/2008 | Brower et al. | |
| 7,891,847 | B2 | 2/2011 | Vukosic et al. | |
| 7,934,851 | B1 | 5/2011 | Boissevain et al. | |
| 7,997,762 | B2 | 8/2011 | Wang et al. | |
| 8,020,270 | B2 | 9/2011 | Elwell | |
| 8,080,819 | B2 | 12/2011 | Mueller et al. | |
| 8,100,557 | B2 | 1/2012 | Chen et al. | |
| 8,159,146 | B1 * | 4/2012 | Lebens et al. | 315/291 |
| 2006/0006821 | A1 * | 1/2006 | Singer et al. | 315/312 |
| 2006/0244118 | A1 | 11/2006 | Roberts et al. | |
| 2007/0159008 | A1 | 7/2007 | Bayat et al. | |
| 2007/0216274 | A1 | 9/2007 | Schultz et al. | |
| 2008/0204888 | A1 | 8/2008 | Kan et al. | |
| 2009/0026484 | A1 | 1/2009 | Hsu et al. | |
| 2009/0323330 | A1 | 12/2009 | Gordin et al. | |
| 2010/0096993 | A1 | 4/2010 | Ashdown et al. | |
| 2010/0188845 | A1 | 7/2010 | Rooms et al. | |
| 2010/0254132 | A1 | 10/2010 | Wassel et al. | |
| 2010/0302762 | A1 | 12/2010 | Liu | |

(Continued)

*Primary Examiner* — Crystal L Hammond

(74) *Attorney, Agent, or Firm* — Endurance Law Group, PLC

(57) ABSTRACT

An LED light source assembly for signage illumination includes one or more planar LED arrays located with respect to a light spreading system for uniformly distributing light onto a viewing surface. The light spreading system includes a plurality of reflectors in combination with a transverse deflector disposed directly above and in the light emanating path of a planar LED array. The transverse deflector is oriented angularly and projects at least a portion of light onto a lateral reflector of the light spreading system. In one embodiment, a heat dissipation fixture is supported external to a housing assembly for improved heat management. The LED arrays and the plurality of reflectors and transverse deflectors are affixed directly to the heat dissipation fixture.

20 Claims, 13 Drawing Sheets

(56) References Cited

U.S. PATENT DOCUMENTS

| | | | | |
|---|---|---|---|---|
| 2011/0031887 | A1 | 2/2011 | Stoll et al. | |
| 2011/0050125 | A1 * | 3/2011 | Medendorp et al. | 315/294 |
| 2011/0063843 | A1 | 3/2011 | Cook | |
| 2011/0075409 | A1 | 3/2011 | Zheng | |
| 2011/0090690 | A1 | 4/2011 | Scott et al. | |
| 2011/0110086 | A1 | 5/2011 | Barnwell et al. | |
| 2011/0194285 | A1 | 8/2011 | Harbers et al. | |
| 2011/0219650 | A1 | 9/2011 | Wright et al. | |
| 2011/0286207 | A1 | 11/2011 | Chan et al. | |

* cited by examiner

LED ASSEMBLY FOR A SIGNAGE ILLUMINATION

CROSS REFERENCE TO RELATED APPLICATIONS

This application is a Continuation-In-Part of U.S. patent application No. Ser. No. 12/790,745 filed May 28, 2010, the entire disclosure of which is hereby incorporated by reference and relied upon.

BACKGROUND OF THE INVENTION

1. Field of the Invention

A light emitting diode (LED) light source assembly for a billboard type sign, and more particularly an improved light spreading system therefor.

2. Related Art

A billboard is a type of signage in the form of a large outdoor advertising structure typically found along busy roadways and other high traffic areas. Billboards often show slogans, visuals and other indicia that are painted or otherwise applied to a large, usually rectangular, vertical surface. Billboard advertisements are designed to visually catch the attention of people passing by and quickly create a memorable impression. To be effective, a billboard sign must present indicia that are visually discernible from a great distance by viewers who may only have line-of-sight exposure to the sign for a very short period of time. During daylight hours, visibility is usually not an issue. However, during times of low-level ambient light, e.g., at night, it is usually necessary to shine a light onto the viewing surface of the billboard to in order to make the indicia visible to distant, transitory viewers.

In most instances, lighting of the billboard is accomplished by a horizontal row of light source assemblies mounted a few feet out from the large rectangular viewing surface either along its bottom or top edge. Traditionally, the lighting source has been an incandescent bulb set in an opaque housing with a clear cover. To disperse the light evenly across the viewing surface, reflectors may be placed behind the bulb inside the housing, and the cover may include light dispersing features like a Fresnel lens. Such traditional approaches were reasonably effective, but were relatively expensive to manufacture, expensive to maintain/repair, expensive to operate, and suffered relatively short life cycles between bulb replacements.

In recent years, incandescent lights have been increasingly replaced by LED (light emitting diode) devices due to the greater efficiency and longevity of an LED light source. High brightness, high efficiency LEDs have been developed to produce white light with an output sufficient for the development of practical lighting. Notwithstanding, LED applications have not successfully extended into billboard signage illumination due, at least in part, to difficulty obtaining an even light dispersion across the viewing surface. In particular, one type of LED light source a planar LED array consolidated onto a single light emitting chip—is well-known for its exceptionally high light output characteristics. However, planar LED arrays have not heretofore been successfully applied to billboard signage illumination applications. Fundamental differences between the emission of light from a planar LED array as compared with an incandescent light source have rendered the traditional light dispersion techniques—chiefly reflectors placed behind the bulb and/or a lensed cover—to be found generally ineffective for planar LED array light source technologies. For example, light output from planar LED array systems are substantially more concentrated along a unidirectional light emission beam, and hence more intense, than the omnidirectional light output from the ubiquitous filament(s) found in an incandescent source. The intense, unidirectional light emission beam from an LED light source, and in particular from a planar LED array configuration, results in a viewing angle so narrow that for billboard applications the traditional cover optics, Fresnel lensing, are not sufficiently effective to achieve the necessary light spread. Furthermore, cover optics, e.g., those crafted with Fresnel lensing, are expensive when compared with a non-lensed cover. Replacement of lensed covers due to damage and extended exposure to the elements contributes significantly to the high cost of traditional lighting solutions. Another obstacle to use of planar LED array technology in billboard signage applications has been the issue of heat management. It is well-known that LED light sources will fail prematurely without effective strategies for heat dissipation.

Thus, despite the recognized advantages of adapting outdoor signage lighting to LED's, there remains serious obstacles to successfully implementing LED concepts in this field due to fundamental differences in the respective light emission characteristics. There is therefore a need in the art for improvements in light dispersion technology sufficient to enable the use of planar LED array light source technology in such a way that results in cheap, robust, high-efficiency, and heat manageable outdoor signage illumination.

SUMMARY OF THE INVENTION

A light emitting diode (LED) light source assembly for a sign in which a message thereon is made more apparent by illumination and wherein the assembly is external to the sign housing. The assembly includes a housing comprising a base and a generally transparent cover. At least one LED module is operatively associated with the housing. The LED module includes a planar LED array consolidated onto a single light emitting chip. The LED array is configured to produce a light emission beam. The LED module includes a heat dissipating fixture. A light spreading system is disposed between the base and the cover. In order to overcome the disadvantages and shortcomings of prior art systems, the light spreading system includes a traverse deflector supported over the LED array and at least partially within the light emission beam thereof. The traverse deflector effectively, inexpensively and durably functions to spread the intense, concentrated light output from a planar LED array to achieve broad and even illumination of a billboard sign. The subject invention can be implemented without resorting to expensive lensed housing covers and does not require any special adaptations to the heat management strategies. As a result, the present invention enables high efficiency light transfer from a planar LED array to a sign surface.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Referring to the figures wherein like numerals indicate like or corresponding parts throughout the several views, a billboard sign is generally shown at 20. The billboard sign 20 is of the type including a large, vertically oriented viewing surface 22 having a generally rectangular configuration. Although not depicted in FIG. 1, the viewing surface 22 is characteristically adorned with messages or other indicia intended to communicate a message of some sort to transient viewers. The billboard sign 20 may be elevated by a support post 24 which is shown as a single, centrally located column. However, in other configurations the support post 24 may comprise two or more stanchions or a supporting framework. In some applications, the billboard sign 20 may omit a support post 24 and be affixed in at elevated position such as to the side of a building.

Figure 1:
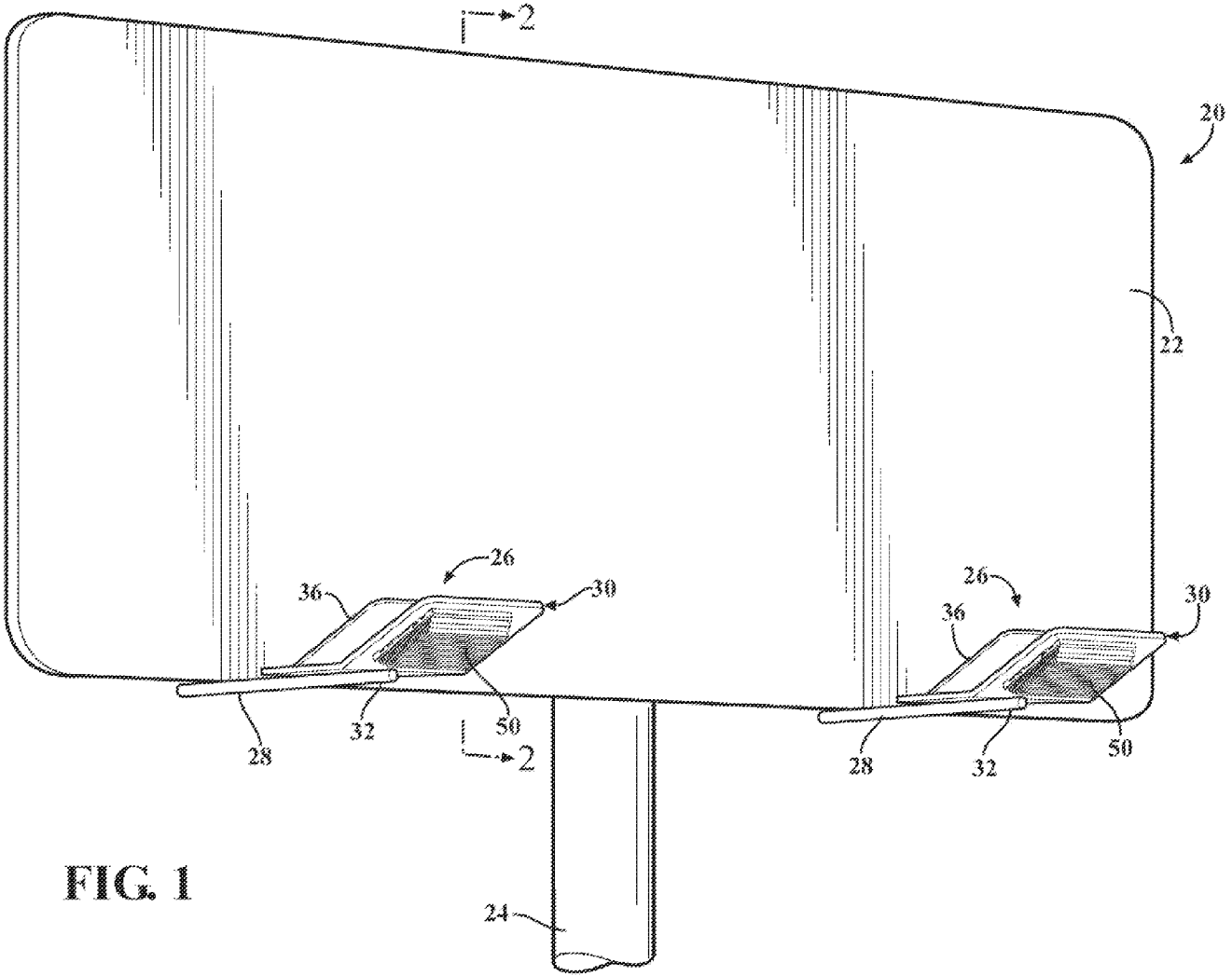
FIG. 1 is a perspective view of an exemplary outdoor billboard sign including two light emitting diode (LED) source assemblies according to the subject invention disposed along the bottom edge of the sign.

A light emitting diode (LED) light source assembly is generally shown at 26. In the example of FIG. 1, two such LED light source assemblies 26 are provided. Each light source assembly 26 is disposed on a bracket aim 28 positioned in front of the viewing surface 22 so that light emitted from the light source assemblies 26 is projected onto the viewing surface 22 at an upward angle. Of course, more or less than two light source assemblies 26 may be utilized depending upon the circumstances and size of viewing surface 22 to be illuminated. Thus, by means of the one or more light source assemblies 26, any message imprinted on the viewing surface 22 is made more apparent by illumination from the external light source assemblies 26.

Figure 2:
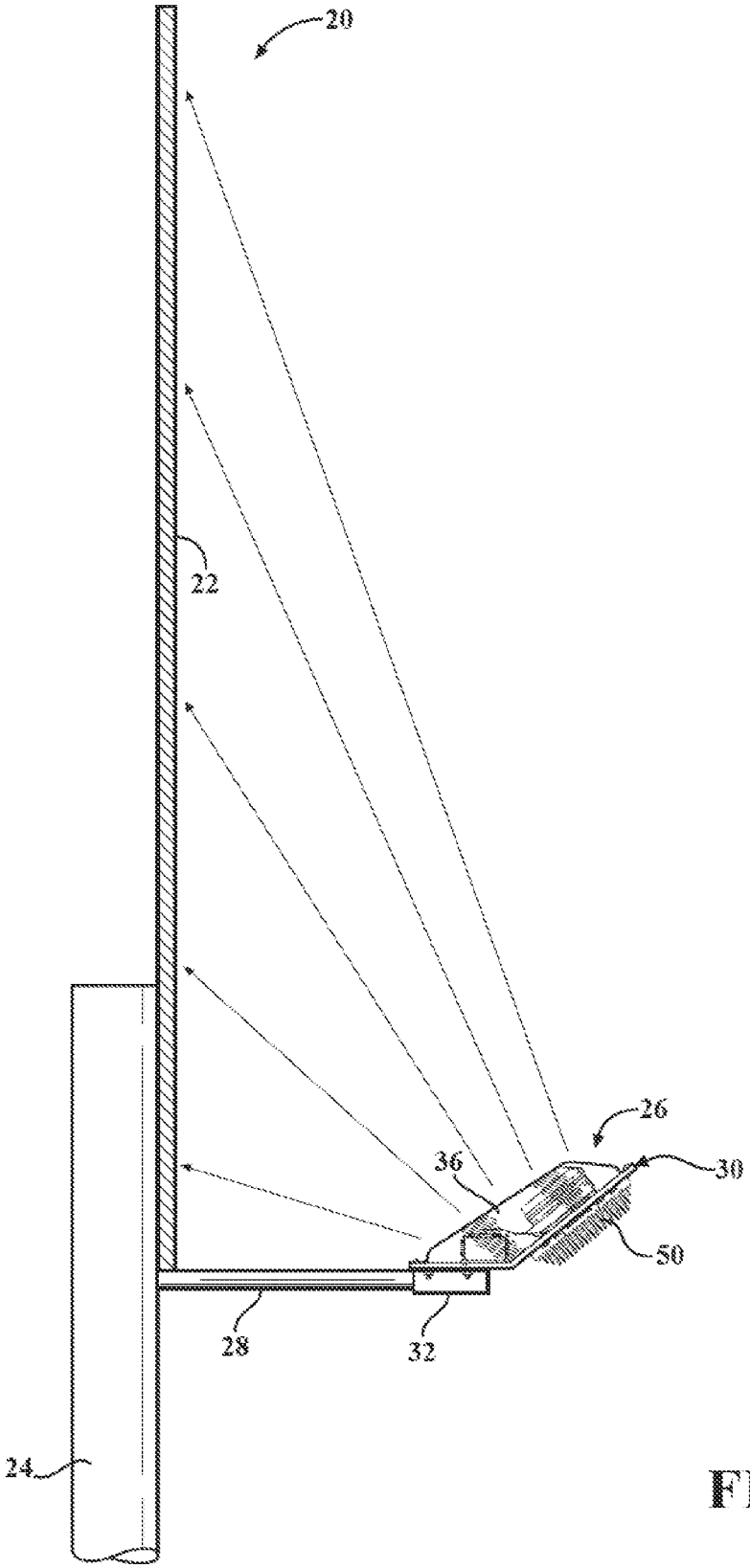
FIG. 2, is a cross-sectional view as taken generally along lines 2-2 in FIG. 1 illustrating light emission patterns from the LED light source assembly.

One of the particular challenges in billboard sign illumination applications such as those depicted in FIGS. 1 and 2 resides in the necessity to spread light from the light source assemblies 26 evenly onto the viewing surface 22 without dark spots or oversaturation, and without excessive light scatter outside of the viewing surface 22. In other words, it is the objective of the one or more light source assemblies 26 to evenly disburse substantially all emitted light onto the viewing surface 22 with very little to no light waste. FIG. 2 illustrates by way of example a particular challenge in such applications because the one or more light source assemblies 26 are typically placed relatively close to a bottom for top) edge of the viewing surface 22 and required to rapidly spread their light upwardly and sideways.

Figure 3:
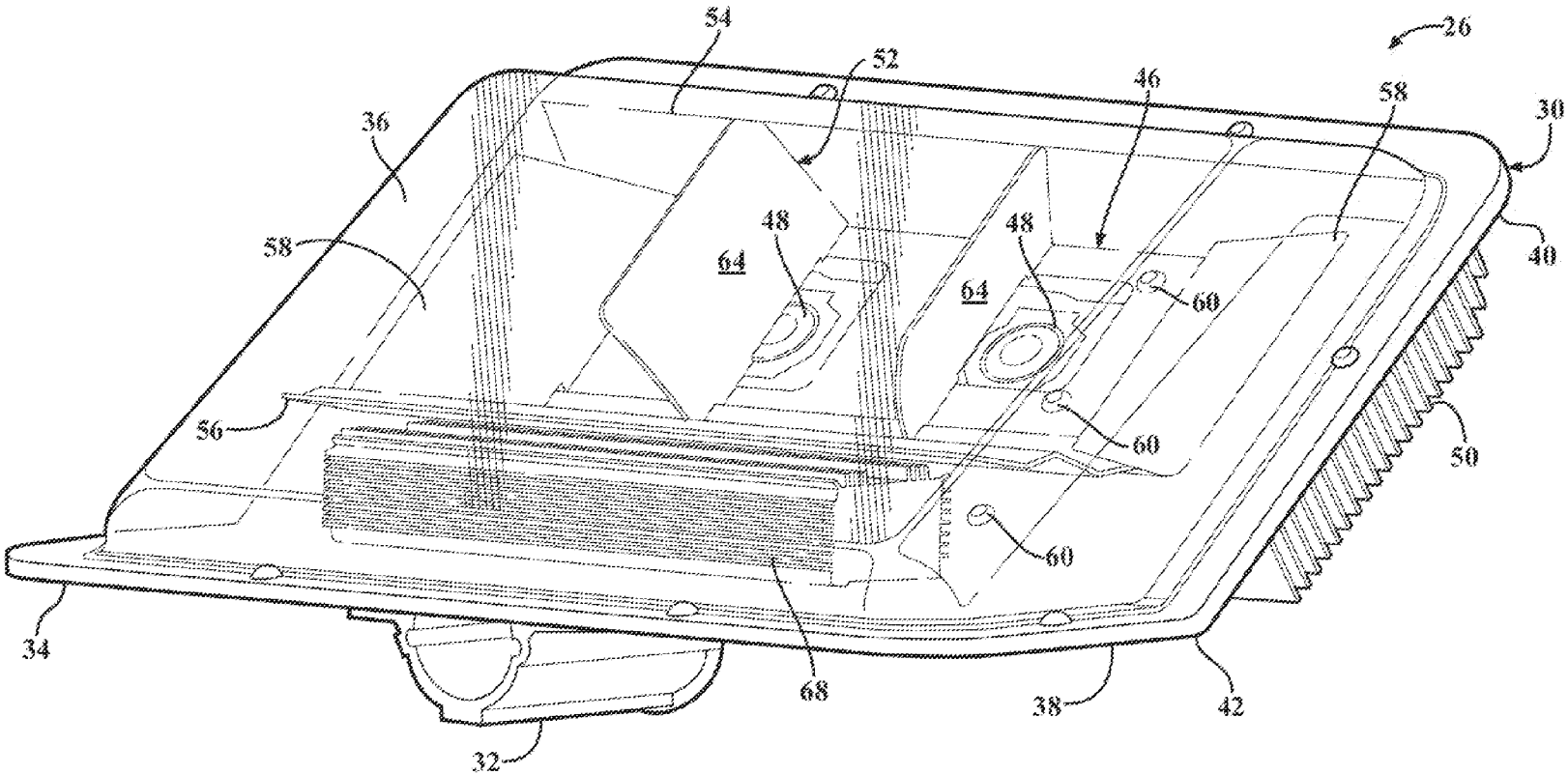
FIG. 3 is a perspective view of the light source assembly as shown in FIGS. 1 and 2.
Figure 4:
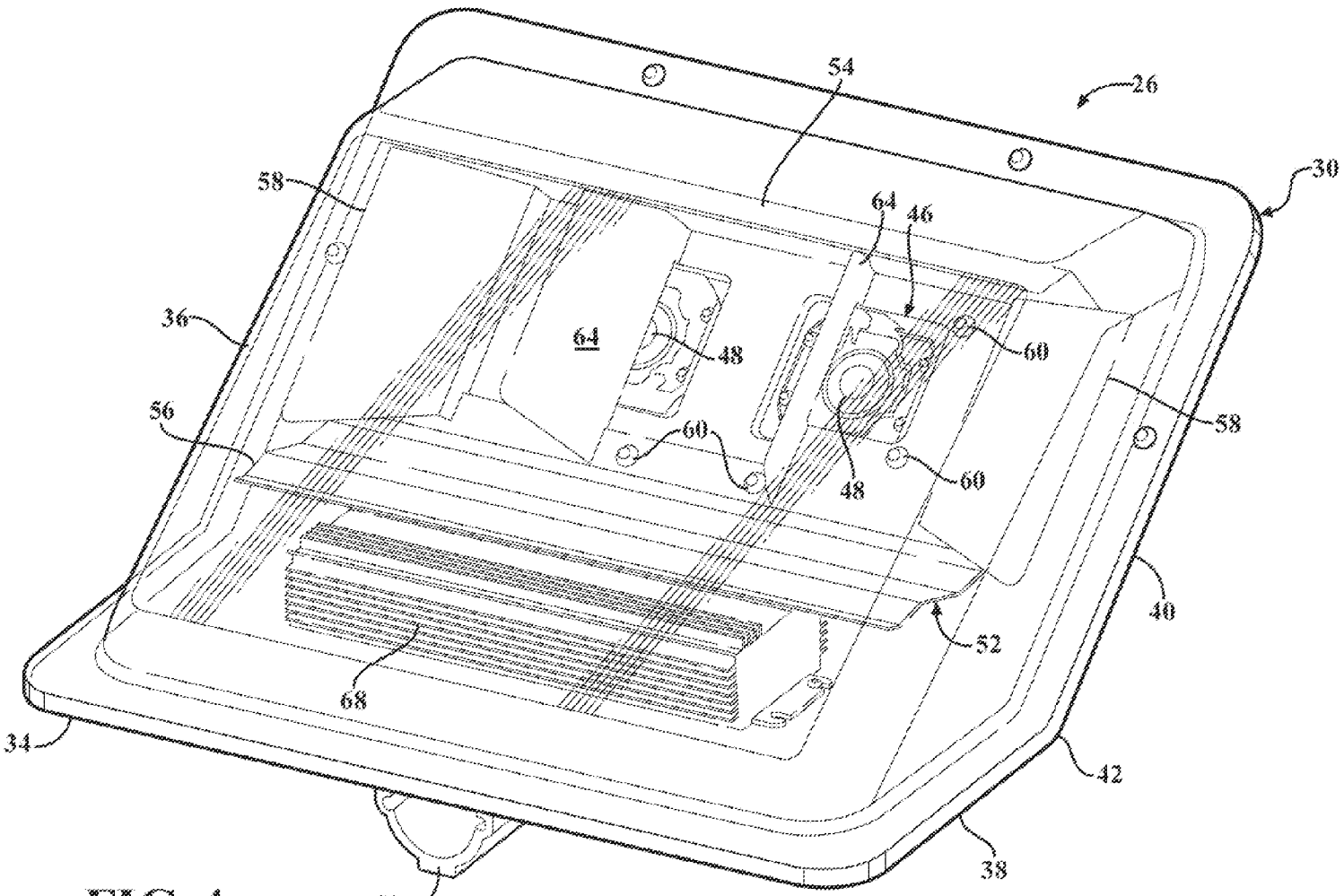
FIG. 4 is a perspective view of the present light source assembly depicted from a different angular vantage from that of FIG. 3.
Figure 5:
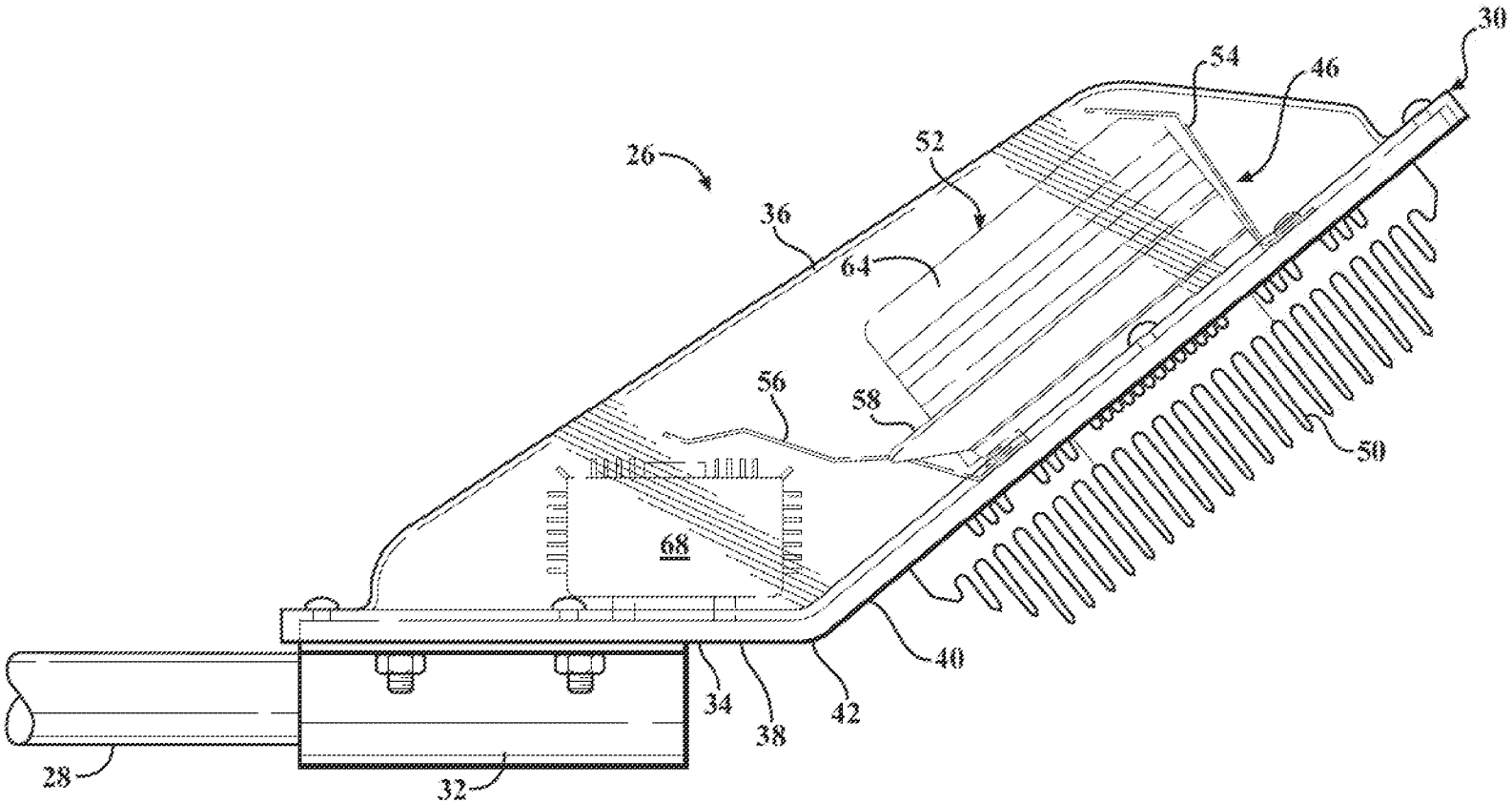
FIG. 5 is a side-elevation view of the LED light source assemblies as shown in FIGS. 3 and 4.
Figure 6:
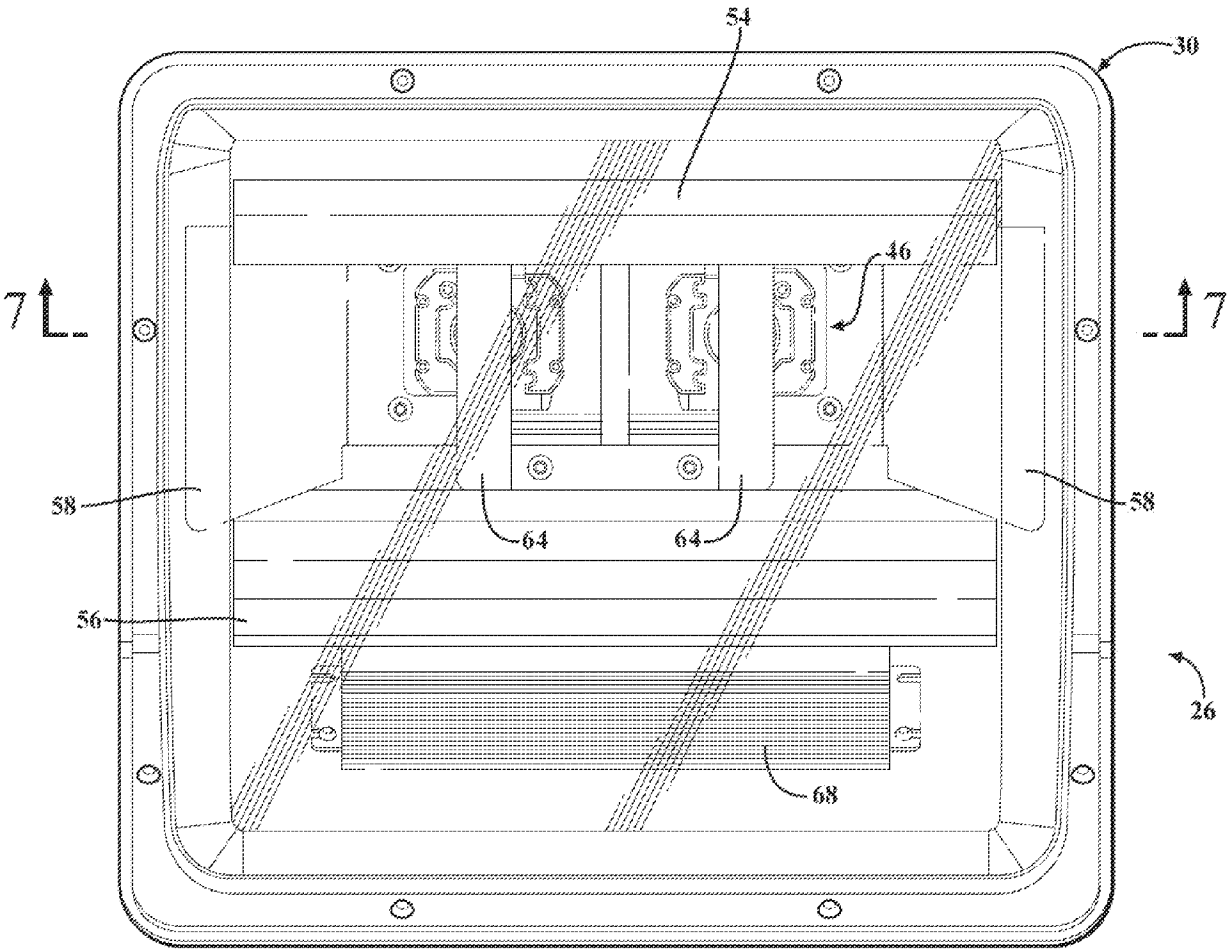
FIG. 6 is a top view of the LED light source assembly.

FIGS. 3 and 4 illustrate one preferred example of a light source assembly 26 which is specially configured and adapted to illuminate the viewing surface 22 of an outdoor billboard sign 20 using effective light dispersion technologies in a manner that is efficient and durable. As shown in FIGS. 3-7, an LED light source assembly 26 includes a housing, generally indicated at 30. The housing 30 may include a mounting bracket 32 adapted to receive a distal end of the bracket aim 28 extending from the bottom edge of the billboard sign 20. In this embodiment, the housing 30 comprises a base 34 and a separable cover 36. The base 34 is generally opaque. Whereas the cover 36 is generally transparent. In the illustrated embodiment, the base 34 is formed of bottom 38 and back 40 panels arranged each as generally planar bodies that adjoin one another along an intersection line 42. As perhaps best shown in FIG. 5, the bottom 38 and back 40 panels may be angularly separated from one another by an oblique included angle greater than 90 degrees and less than 180 degrees. In the illustrated example, the oblique included angle is about 135 degrees. A pass-through opening 44 (FIG. 7) is disposed in the back panel 40.

At least one LED module, generally indicated at 46, is operatively associated with the housing 30. In the preferred embodiment depicted here in FIGS. 2-10, two LED modules 46 are associated with the housing 30. In other embodiments, more or less than two LED modules 46 may be used in association with one common housing 30. Each LED module 46 includes a planar LED array 48 consolidated onto a single light emitting chip. Each LED array 48 is configured to produce a light emission beam depicted as radiating arrows for example in FIGS. 2, 9 and 10. In one embodiment, the LED arrays 48 are aligned with the pass-through opening 44 in the back panel 40. Thus, light emission beam from each LED array 48 shines through the pass-through opening 44 in the back panel 40. The light emission beam emanating from each LED array 48 is, at least initially, predominantly perpendicular to the back panel 40. The light emission beam is composed of a spectrum of light which, in one exemplary embodiment, has a temperature specification in the range of 5,000-7,000 degrees Kelvin. Those of skill in the art may consider light emission beams composed of light spectrums having different specifications as being suitable as well.

Figure 7:
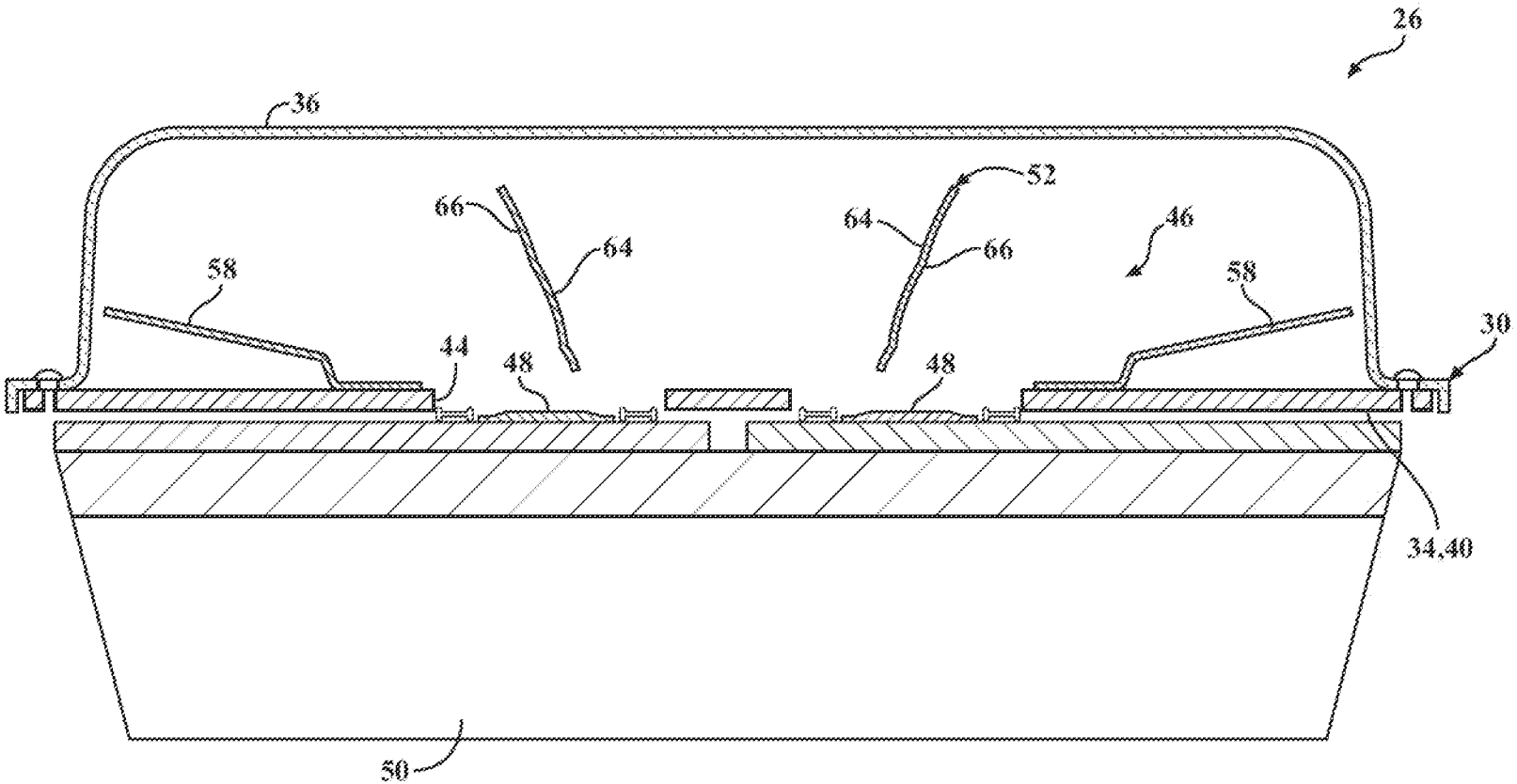
FIG. 7 is a simplified cross-sectional view taken generally along lines 7-7 in FIG. 6.
Figure 8:
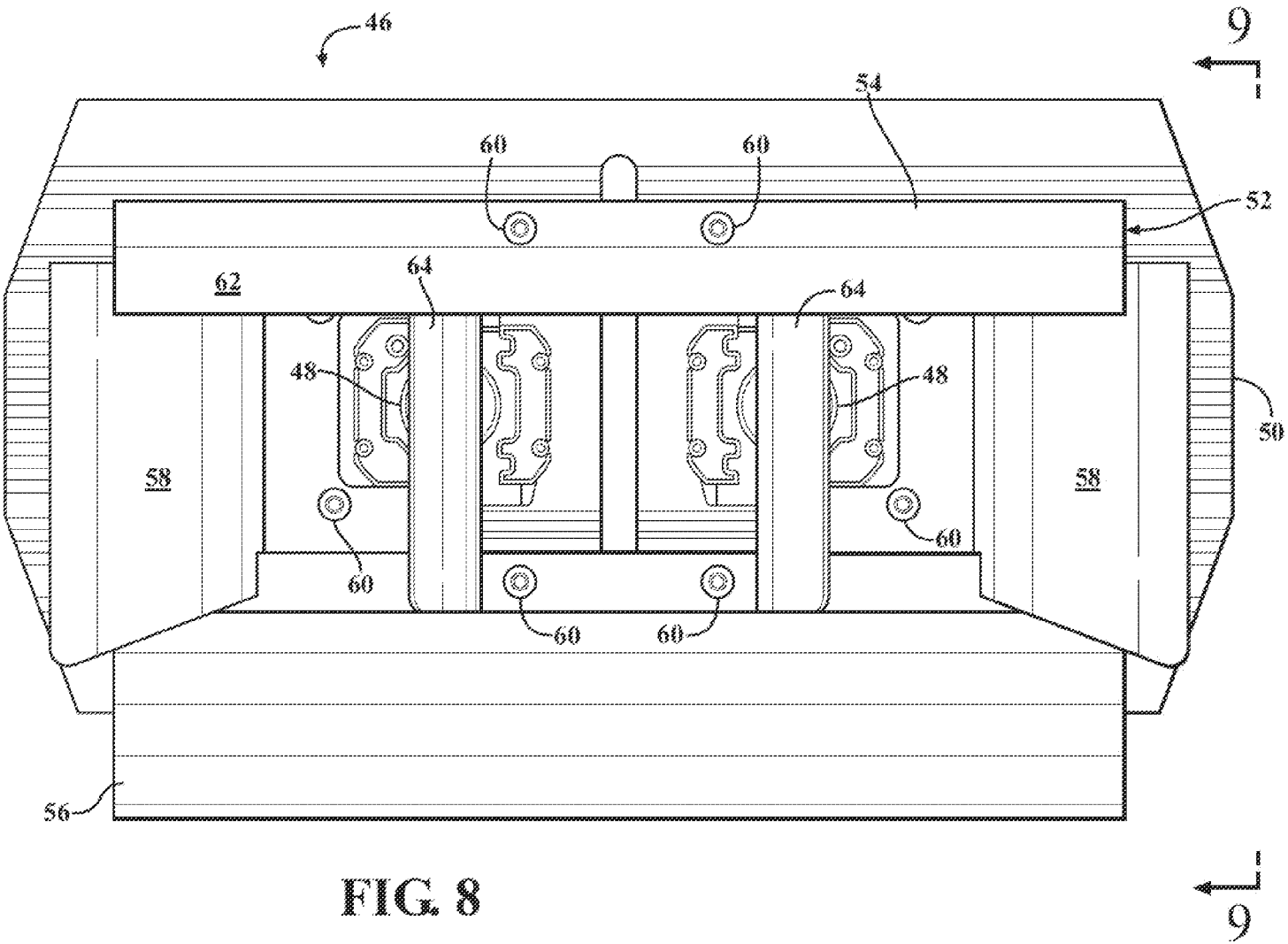
FIG. 8 is an enlarged top view of the LED module, light spreading system and heat dissipating fixture according to a preferred embodiment of this invention.

Each LED module 46 also includes a heat dissipation fixture 50. The heat dissipation fixture 50 is preferably an aluminum or other thermally conducting metallic construction attached directly to the one or more planar LED arrays 48 for improved heat management functionality, as shown in FIG. 7. However, those of skill in the art may envision other suitable arrangements for managing heat. Likewise, the heat dissipating fixture 50 may take many different forms but in the depicted embodiment includes a plurality of cooling fins arranged parallel to one another and generally parallel to the intersection line 42. In other words, the orientation of the cooling fins rims generally parallel to the intersection line 42 and parallel to the viewing surface 22 of the billboard 20. The heat dissipating fixture 50 is attached also to the back panel 40 using suitable fasteners and is arranged so as to substantially cover the pass-through opening 44 in the back panel 40.

Figure 9:
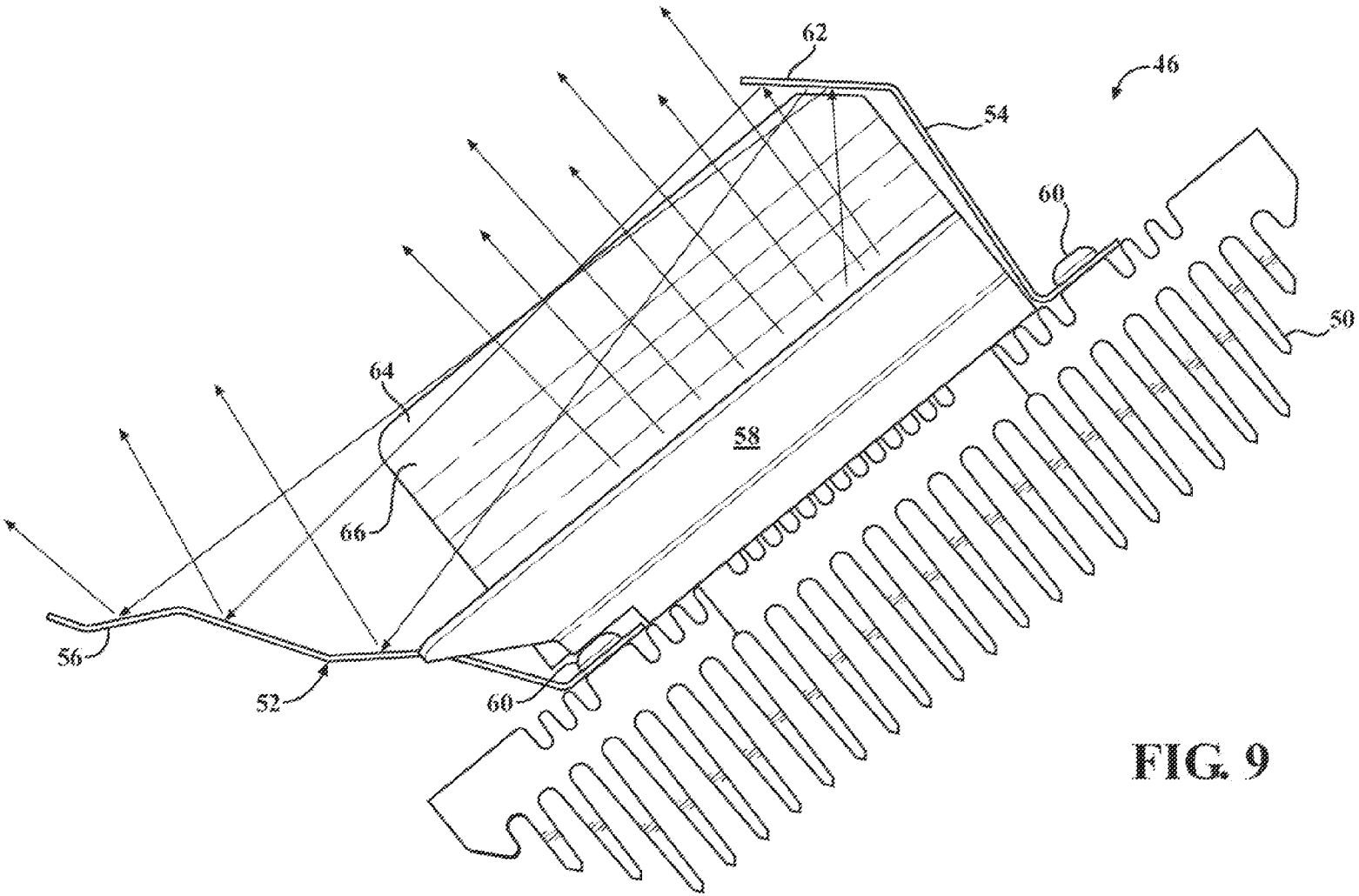
FIG. 9 is an end view taken generally along lines 9-9 in FIG. 8 and depicting the light spreading characteristics resulting from the light spreading system of the invention.

In order to achieve the desired uniform illumination of the viewing surface 22, the LED module 46 is provided with a light spreading system generally indicated at 52. In the preferred embodiment, the light spreading system 52 is disposed between the base 34 and the cover 36. In other words, the cover 36 shelters and protects the light spreading system 52 so that preferably, it is not directly exposed to rain water and other environmental debris. More particularly, the light spreading system 52 includes a top reflector 54 and a bottom reflector 56 and a lateral reflector 58. The top reflector 54 is shown disposed adjacent the LED array 48 and extends generally parallel to the intersection line 42. Perhaps as best shown in FIG. 9, the top reflector 54 may be attached directly or indirectly to the heat dissipation fixture 50 by fasteners 60. The top reflector 54 may include a bent upper section 62 which functions effectively to prevent the unwanted escape of light over the top of the viewing surface 22. The bottom reflector 56 is disposed on the opposite side of the LED arrays 48 from the top reflector 54 and also extends generally parallel to the intersection line 42. The bottom reflector 56 may include a series of folds or zigzags as shown in FIG. 9 to strategically orient and disperse light emanating from the one or more LED arrays 48 onto the viewing surface 22. The lateral reflectors 58 are perhaps best shown in FIG. 10. One lateral reflector 58 is associated with each planar LED array 48. In other constructions, it may be possible to utilize fewer or additional lateral reflectors 58. The lateral reflectors 58 are also disposed adjacent the respective LED arrays 48 but are oriented generally perpendicular to the intersection line 42 so as to assist in the distribution of light in directions laterally or sideways of the assembly 26. The bottom 56 and lateral 58 reflectors may also be attached directly or indirectly to the heat dissipation fixture 50 by suitable fasteners 60.

Figure 10:
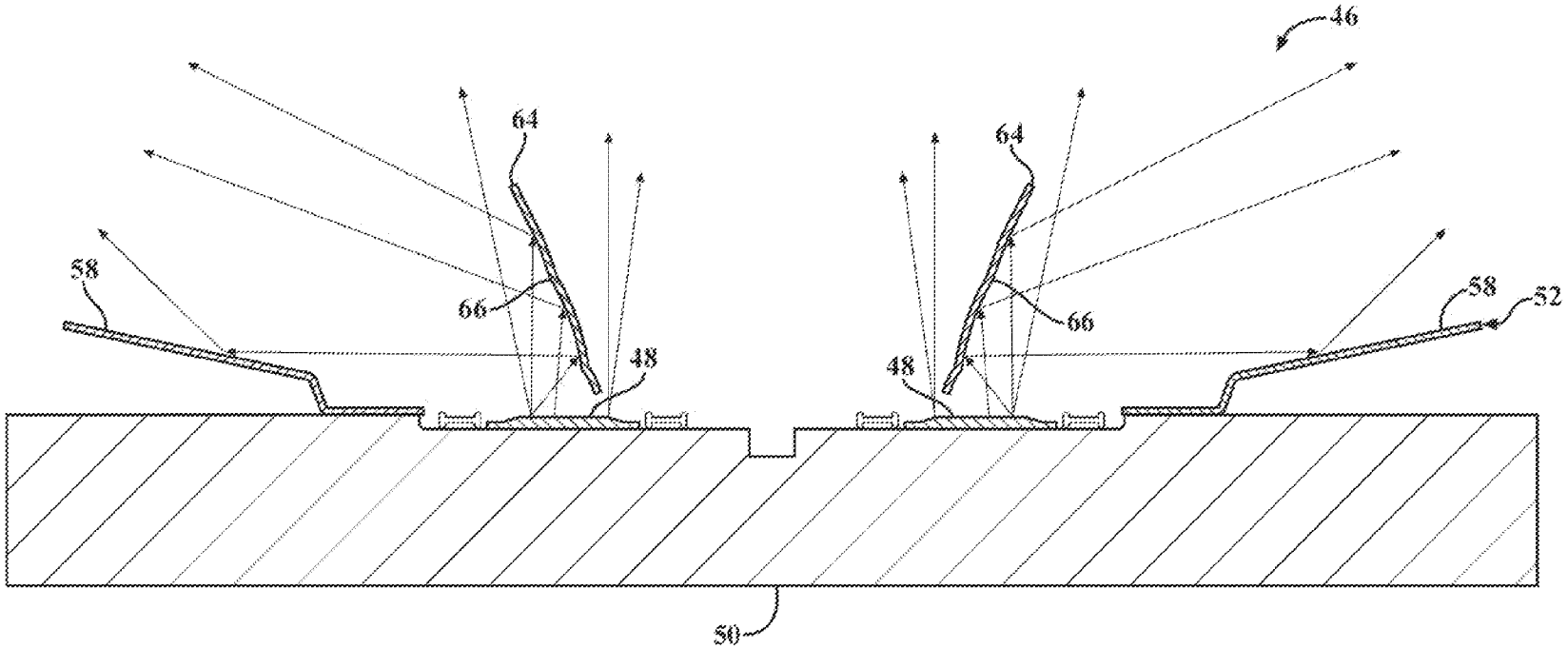
FIG. 10 is a simplified cross-sectional view as in FIG. 7 depicting the light spreading characteristics of the light spreading system in lateral (i.e., side-to-side) directions.

The light spreading system 52 also includes at least one transverse deflector 64 associated with each LED array 48. That is, a transverse deflector 64 is supported over each LED array 48 and at least partially within the light emission beam thereof. The light transverse deflector preferably deflects at least 50 percent of all light emanating in a normal direction, i.e., perpendicularly, from the LED array. This is perhaps best shown in FIG. 10. Each transverse deflector 64 includes at least one reflective surface 66 which may be creased or undulating slightly as shown in FIG. 10. The creased undulations provide improved photometric properties as well as increase durability for the otherwise thin, metallic members. The reflective surface 66 of each transverse deflector 64 is directed toward the adjacent lateral reflector 58 as shown in FIG. 10 so that at least some light from the LED array 48 is projected by reflection onto the lateral reflector 58. In the preferred embodiment, this is accomplished by angularly supporting each transverse deflector 64 over the LED array 48. The angular disposition is considered relative to the planar nature of the LED array 48 and its underlying base plate 34. Suitable fasteners 60 may be similarly used to directly or indirectly affix the transverse deflectors 64 to the heat dissipation fixture 50.

Returning again to FIGS. 3-5, the light source assembly 26 is shown including an LED driver 68 which is electronically coupled to the LED module 46 for controlling the functionality of the LED arrays 48. Preferably, the LED driver 68 is protected within the housing 30 and disposed between the cover 36 and the base 34. This shelters the LED driver from direct contact with the elements, as well as its electrical wires and couplings from elemental exposure. More particularly, in this embodiment the LED driver 68 is mounted directly to the bottom panel 38 portion of the base 34. As perhaps best shown in FIG. 5, the bottom reflector 56 is preferably structured and oriented so as to substantially shield the LED driver 68 from the light emission beam and thereby further enhance control of the light projected onto the viewing surface 22 of the billboard 20.

The invention as depicted in FIGS. 1-10 possesses many advantages and attributes including, but not limited to, the ability to utilize a clear, non-lensed cover 36 which allows inexpensive and more easily maintained optics, as well as improved light transmission for better efficiency. Furthermore, the heat dissipation fixture 50 is preferably located exterior to the enclosure created between the base 34 and cover 36 thereby enhancing heat rejection and improving heat management. Furthermore, the improved light spreading, system 52 includes one or more transverse deflectors 64 positioned directly over a planar LED array 48 so as to divert at least a portion of its emitted light toward a lateral reflector 58. The light spreading system 52 is affixed either directly or indirectly to the heat dissipation fixture 50 thus further improving heat management ability. This combination of features is particularly effective in enabling the use of planar LED array technology for billboard illumination applications.

Figure 11:
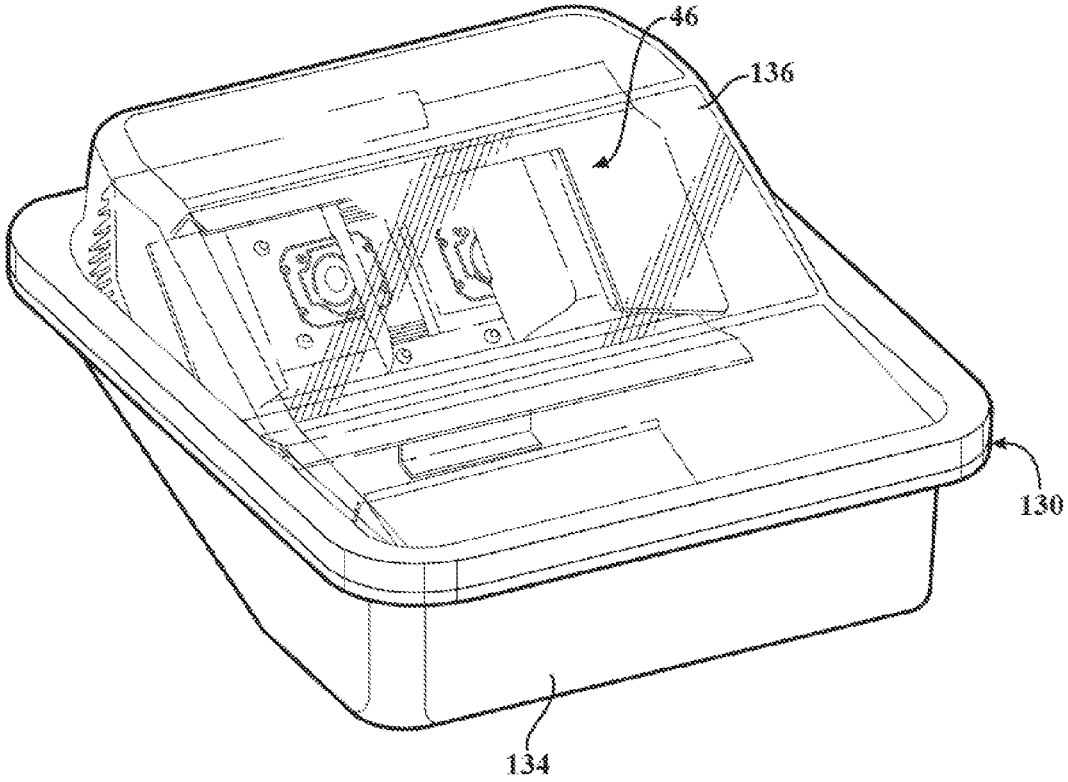
FIG. 11 is an assembled perspective view of the present invention as configured in a first alternative embodiment of the housing.
Figure 12:
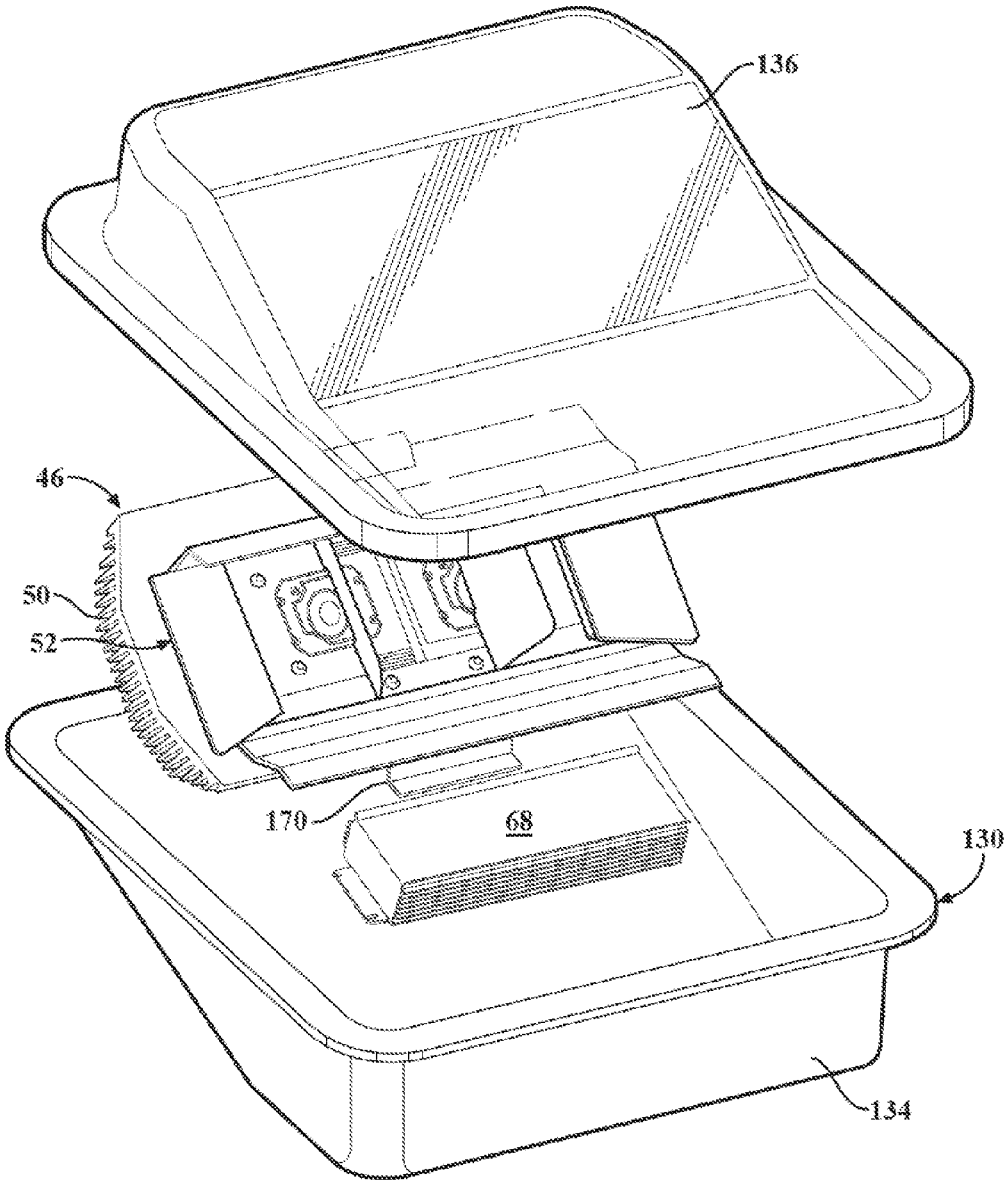
FIG. 12 is an exploded view of the alternative assembly as shown in FIG. 11.
Figure 13:
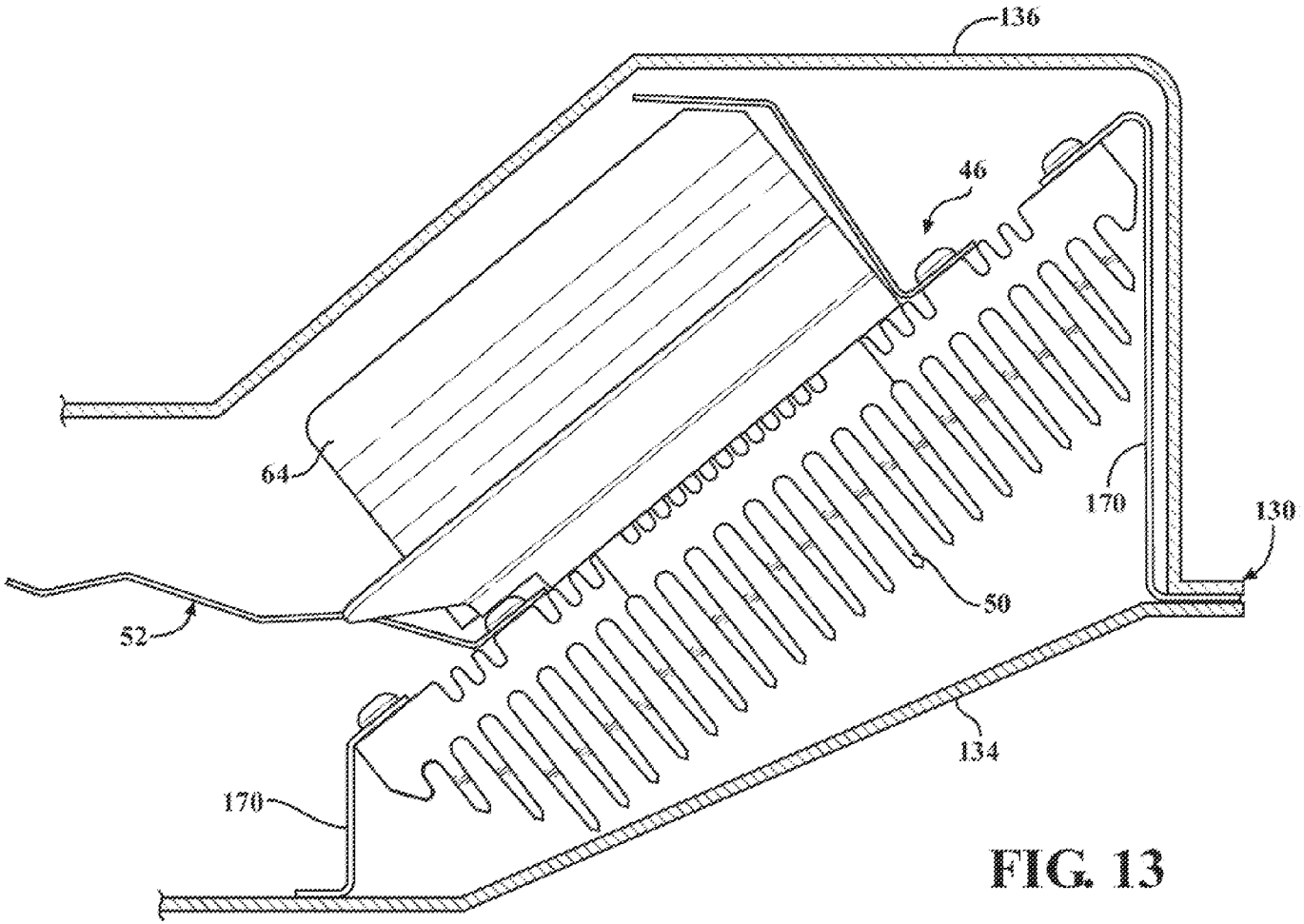
FIG. 13 is a simplified cross-sectional view of the alternative light source assembly of FIG. 11.

Turning now to FIGS. 11-13, a first alternative embodiment of the present invention is depicted wherein the housing is altered so as to accommodate retrofit applications with certain traditional incandescent type billboard illumination assemblies. In this example, the housing 130 is shown including a generally opaque base 134 having a tub-like construction along with a generally transparent cover 136. In this example, the base 134 does not include a pass-through opening, but rather is entirely sealed by the cover 136. Thus, the heat dissipation fixture of the LED module 46, which is substantially identical to that described above in connection with FIGS. 1-10, is disposed inside an enclosed housing 130. As shown in FIG. 12, support brackets 170 may be attached to the heat dissipation fixture 50 and used to angularly orient the LED module 46 within the base 134.

The present invention effectively utilizes planar style LED allay chips for billboard signage illumination. Coupled with the proper drivers, heat dissipating fixtures and light spreading systems, the present invention achieves a much wider spectrum of light than conventional lighting alternatives (5,000-5,500° K). As a result, the perceived light emitted from a light fixture according to this invention is much higher than conventional counterparts, and is much easier on the human eyes. In proper replacement applications, the present invention represents substantial electricity savings while improving performance in terms of visual effectiveness. Planar LED arrays of the type utilized in this invention may be selected in the range of about 5,000 degrees Kelvin, which is very close to the daylight spectrum, with no UV pollution. As a consequence, they may be considered healthier for human eyes than traditional light sources and create better visibility. The LED module of this invention may be easily configured to contain no mercury or lead, and have no filament to break or casings to explode. They are naturally resistant to heat, cold and shock. They produce no flicker, no buzz, and output no UV or infrared radiation.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A light emitting diode (LED) light source assembly for a sign in which a message thereon is made more apparent by illumination and wherein said assembly is external to the sign housing, said assembly comprising:

a housing, said housing comprising a base and a generally transparent cover, at least one LED module operatively associated with said housing, said LED module including a planar LED array consolidated onto a single light emitting chip, said LED array configured to produce a light emission beam, said LED module including a heat dissipating fixture, said LED module including a light spreading system disposed between said base and said cover, wherein the improvement comprises:

said light spreading system including a traverse deflector supported over said LED array and at least partially within said light emission beam thereof.

2. The assembly of claim 1 wherein said transverse deflector is positioned relative to said LED array to deflect at least 50% of all light emanating in a normal direction from said LED array.

3. The assembly of claim 1 wherein said light spreading system includes a low-angle lateral reflector, and said transverse deflector includes at least one reflective surface directing light from said light emission beam toward said low-angle lateral reflector.

4. The assembly of claim 3 wherein said reflective surface of said transverse deflector is generally planar.

5. The assembly of claim 3 wherein said reflective surface of said transverse deflector is angularly supported relative to said base plate.

6. The assembly of claim 1 wherein said base comprises bottom and back panels, said back panel having a pass-through opening therein, said LED array disposed generally within said pass-through opening in said back panel so that said light emission beam emanates predominantly perpendicular to said back panel.

7. The assembly of claim 6 wherein said heat dissipating fixture attached to said back panel and substantially covering said pass-through opening therein.

8. The assembly of claim 7 wherein said heat dissipating fixture is attached directly to said LED array, said heat dissipating fixture made from a metallic material, said heat dissipating fixture including a plurality of cooling fins.

9. The assembly of claim 6 wherein said bottom and back panels each being generally planar bodies, said bottom and back panels intersecting one another along an intersection line, said bottom and back panels being angularly separated from one another by an oblique included angle greater than 90 degrees and less than 180 degrees.

10. The assembly of claim 1 wherein said light spreading system includes a top reflector and a bottom reflector and a low-angle lateral reflector.

11. The assembly of claim 10 further including an LED driver electrically coupled to said LED module for controlling said LED array, said LED driver disposed between said cover and said base.

12. The assembly of claim 11 wherein said bottom reflector substantially shields said LED driver from said light emission beam.

13. The assembly of claim 12 wherein said LED driver is mounted directly to said bottom panel.

14. The assembly of claim 10 wherein said top reflector disposed adjacent said LED array, said top reflector extending generally parallel to said intersection line.

15. The assembly of claim 10 wherein said bottom reflector disposed on the opposite side of said LED array from said top reflector, said bottom reflector extending generally parallel to said intersection line.

16. The assembly of claim 10 wherein said lateral reflector disposed adjacent said LED array, said lateral reflector extending generally perpendicular to said intersection line.

17. The assembly of claim 1 further including a mounting bracket affixed to said housing.

18. The assembly of claim 1 wherein said base is generally opaque.

19. A light emitting diode (LED) light source assembly for a sign in which a message thereon is made more apparent by illumination and wherein said assembly is external to the sign housing said assembly comprising:

a housing, said housing comprising a base and a separable cover, said cover being generally transparent, at least one LED module operatively associated with said housing, said LED module including a planar LED array consolidated onto a single light emitting chip, said LED array configured to produce a light emission beam, said LED module including a heat dissipating fixture, said heat dissipating fixture attached directly to said LED array, said LED module including a light spreading system disposed between said base and said cover, said light spreading system including a bottom reflector and a low-angle lateral reflector, an LED driver electrically coupled to said LED module for controlling said LED array, said LED driver disposed between said cover and said base, and said light spreading system including a traverse deflector, said transverse deflector supported over said LED array and at least partially within said light emission beam thereof, said transverse deflector including at least one reflective surface directed toward said low-angle lateral reflector, said reflective surface of said transverse deflector being angularly supported relative to said base plate, said bottom reflector substantially shielding said LED driver from said light emission beam.

20. A light emitting diode (LED) light source assembly for a sign in which a message thereon is made more apparent by illumination and wherein said assembly is external to the sign housing said assembly comprising:

a housing, said housing comprising a base and a cover, said cover being generally transparent, said base comprising bottom and back panels, said bottom and back panels each being generally planar bodies, said bottom and back panels intersecting one another along an intersection line, at least one LED module operatively associated with said housing, said LED module including a planar LED array consolidated onto a single light emitting chip, said LED array configured to produce a light emission beam, said light emission beam emanating predominantly perpendicular to said back panel, said LED module including a heat dissipating fixture, said heat dissipating fixture attached directly to said LED array, said heat dissipating fixture made from a metallic material, said heat dissipating fixture including a plurality of cooling fins, said cooling fins being arranged parallel to one another and generally parallel to said intersection line, said heat dissipating fixture attached to said back panel and substantially covering said pass-through opening therein, said LED module including a light spreading system disposed between said base and said cover, said light spreading system including a top reflector and a bottom reflector and a lateral reflector, said top reflector disposed adjacent said LED array, said top reflector extending generally parallel to said intersection line, said bottom reflector disposed on the opposite side of said LED array from said top reflector, said bottom reflector extending generally parallel to said intersection line, said lateral reflector disposed adjacent said LED array, said lateral reflector extending generally perpendicular to said intersection line, an LED driver electrically coupled to said LED module for controlling said LED array, said LED driver disposed between said cover and said base, said LED driver mounted to said bottom panel, a mounting bracket affixed to said housing wherein the improvement comprises:

said light spreading system including a traverse deflector, said transverse deflector disposed adjacent said LED array, said transverse deflector being supported over said LED array and at least partially within said light emission beam thereof, said transverse deflector deflecting, at least 50% of all light emanating in a normal direction from said LED array, said transverse deflector including at least one reflective surface directed toward said lateral reflector, said reflective surface of said transverse deflector being angularly supported relative to said base plate, said bottom reflector substantially shielding said LED driver from said light emission beam, said back panel having a pass-through opening therein, said LED array disposed generally within said pass-through opening in said back panel.

* * * * *